US005405127A

United States Patent [19]

Welborn

[11] Patent Number: 5,405,127

[45] Date of Patent: Apr. 11, 1995

[54] SIGNATURE FOLDER APPARATUS FOR WEB FED PRINTING PRESS WITH SHEET STOP ADJUSTMENT

[75] Inventor: Ronald D. Welborn, Coral Springs, Fla.

[73] Assignee: Didde Web Press Corporation, Emporia, Kans.

[21] Appl. No.: 48,125

[22] Filed: Apr. 14, 1993

[51] Int. Cl.[6] ..... B41F 13/56; B65H 45/04

[52] U.S. Cl. ..... 270/21.1; 493/417; 493/445

[58] Field of Search ..... 270/4, 6, 10, 19, 32, 270/42, 43, 16, 20.1, 21.1, 38, 45; 493/417, 422, 437, 444, 445

[56] References Cited

U.S. PATENT DOCUMENTS

| | | | |
|---|---|---|---|
| 585,117 | 6/1897 | Nichols | 493/417 |
| 588,694 | 8/1897 | Dexter | 493/417 X |
| 1,541,351 | 6/1925 | Hall | 493/444 |
| 2,470,754 | 5/1949 | Alber | 493/444 X |
| 3,041,987 | 7/1962 | Kaplan et al. | 493/437 X |
| 3,074,710 | 1/1963 | Olson | 493/444 X |
| 3,632,104 | 1/1972 | Dufour | 493/444 |
| 4,419,088 | 12/1983 | Nemec | 493/444 |
| 4,427,405 | 1/1984 | Hoshi | 493/444 |
| 4,746,108 | 5/1988 | Hirayama et al. | 493/437 X |
| 4,861,326 | 8/1989 | Kuhner et al. | 493/359 |
| 5,060,569 | 10/1991 | Gladow | 101/216 |
| 5,158,524 | 10/1992 | Muto et al. | 493/444 X |

*Primary Examiner*—Edward K. Look
*Assistant Examiner*—John Ryznic
*Attorney, Agent, or Firm*—Hovey, Williams, Timmons & Collins

[57] ABSTRACT

A sheet folder apparatus for use with a web-fed printing press includes upstream and downstream folding assemblies and a conveyor for delivering cross-folded sheets from the upstream assembly to the downstream assembly. A head stop is positioned within the delivery path defined by the conveyor for limiting the movement of the cross-folded sheet along the path and for positioning the sheet relative to the downstream folding assembly. The position of the head stop along the delivery path may be adjusted during operation of the apparatus so that it is not necessary to shut the apparatus down to make adjustments to accommodate various signature size and format changes in the apparatus. A registration system is also included for registering the two folding assemblies relative to the apparatus when either the upstream assembly is replaced or the downstream assembly is enabled.

14 Claims, 5 Drawing Sheets

10
12
14
20
22
24
26
28
30
32
34
36
38
40
42
44
126
126'
128
128'
130
132
134
136
138
140
142
144
146
148
150
152
154
160
162
170
172
174
176

SIGNATURE FOLDER APPARATUS FOR WEB FED PRINTING PRESS WITH SHEET STOP ADJUSTMENT

BACKGROUND OF THE INVENTION

1. Field of the Invention

The present invention relates generally to signature folding devices for web-fed printing presses and, more particularly, to a folder apparatus which allows on-the-fly adjustment of the folding operation to accommodate different press speeds and variable signature sizes.

2. Discussion of the Prior Art

In a conventional signature folder designed for use with web-fed newspaper or large publication presses, a number of folding stations are provided for producing a single, fixed-size product.

Typically, an upstream folder cuts the web into sheets and folds the web along a line extending in a direction transverse to the web. This cross-folded signature is then delivered onto a conveyor and can, if desired, be folded again along a line extending in a direction transverse to the cross fold line. The subsequent fold is formed by a chopper, which is a thin piece of spring steel that is lowered onto each signature as it travels along the conveyor, forcing the signature between two inwardly rotating rollers.

In order to properly align each signature with the chopper, it is known to provide a stationary head stop extending across the conveyor within the travel path of the signatures so that each signature strikes the stop and is squared relative to the chopper prior to the chop-folding operation so that it will be folded accurately.

If the head stop is not properly positioned along the conveyor, the signatures approaching the chopper will either be engaged by the chopper before striking the head stop, in which case the signatures are not always square, or strike the head stop with such force as to damage the signature, e.g. by bending the corners over or the like.

Thus, it is necessary to determine where the stop should be positioned along the conveyor in order to stop and square the signatures without damaging them. Unfortunately, once the head stop is adjusted for use at any particular press speed, it is not suitable for other press speeds. For example, if the stop is mounted in a position suitable for a given press speed, and the speed is increased, the signatures traveling on the conveyor have greater momentum, hitting the stop harder. Thus, damage to the signatures occurs unless the device is first shut downs and the position of the head stop is adjusted for the new press speed.

Another solution is to adjust the timing of the chopper movement relative to the moving signature so that the chopper engages the signature after the signature is squared but before the momentum of each signature carries it into the head stop with so much force as to cause damage to the signature. Although this solution reduces or eliminates down time of the press, it requires a special variable mechanical transmission and increases the cost of the press substantially.

OBJECTS AND SUMMARY OF THE INVENTION

It is an object of the present invention to provide a signature folder apparatus for use with various sizes of signatures, wherein relatively few parts are employed so that setup and maintenance of the apparatus are simplified.

It is another object of the present invention to provide an apparatus including means for adjusting the position of each signature relative to a chopper folder so that the signatures are protected against damage during alignment with the chopper, and high quality products are produced.

It is yet another object of the present invention to provide a folder apparatus within which each cross-folded signature is supported during a subsequent folding operation in order to prevent the signature paper from whipping freely during the operation.

In accordance with these and other objects evident from the following description of a preferred embodiment, a sheet folding apparatus is provided for use with a web-fed printing press, wherein the apparatus includes an upstream folding means for cutting the web into sheets and cross folding each sheet along a fold line extending in a direction transverse to the length of the web, a conveyor means for delivering the cross-folded sheets from the upstream folding means along a delivery path, and a downstream folding means positioned along the delivery path for chop-folding the cross-folded sheets along a fold line extending in a direction transverse to the cross fold line, and for delivering the chop-folded sheets from the apparatus.

A head stop is positioned within the delivery path of the apparatus for limiting the movement of the sheet along the path and for positioning the sheet relative to the downstream folding means. The position of the head stop along the delivery path is adjustable during operation of the apparatus so that such adjustments may be made on the fly to accommodate variable press speeds.

In accordance with another aspect of the present invention, a drive means is provided for driving the upstream folding means, and a transmission means transmits the drive of the upstream folding means to the downstream folding means. A cassette supports the upstream folding means and is removable from the apparatus to allow replacement of the cassette and of the upstream folding means. In addition, the downstream folding means may be enabled and disabled independently of the upstream folding means. A registration means is provided for registering the two folding means with the transmission means and with each other so that after the cassette is replaced or the downstream folding means is enabled, the two folding means may be registered with one another. In addition, the registration means provides registration between the folder apparatus and the upstream web-fed printing press.

By providing a signature folder apparatus in accordance with the present invention, numerous advantages are achieved. For example, by permitting adjustment of the position of the head stop along the delivery path, it is possible to locate the head stop so that the signature is stopped and squared relative to the downstream folding means without being damaged. In addition, by enabling this adjustment to be made during operation of the downstream folding means, no down time of the apparatus is required, and it is possible to adjust the position of the head stop to accommodate changing press speeds, variable signature sizes, and different folding configurations without adversely effecting production.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figures 1, 10:
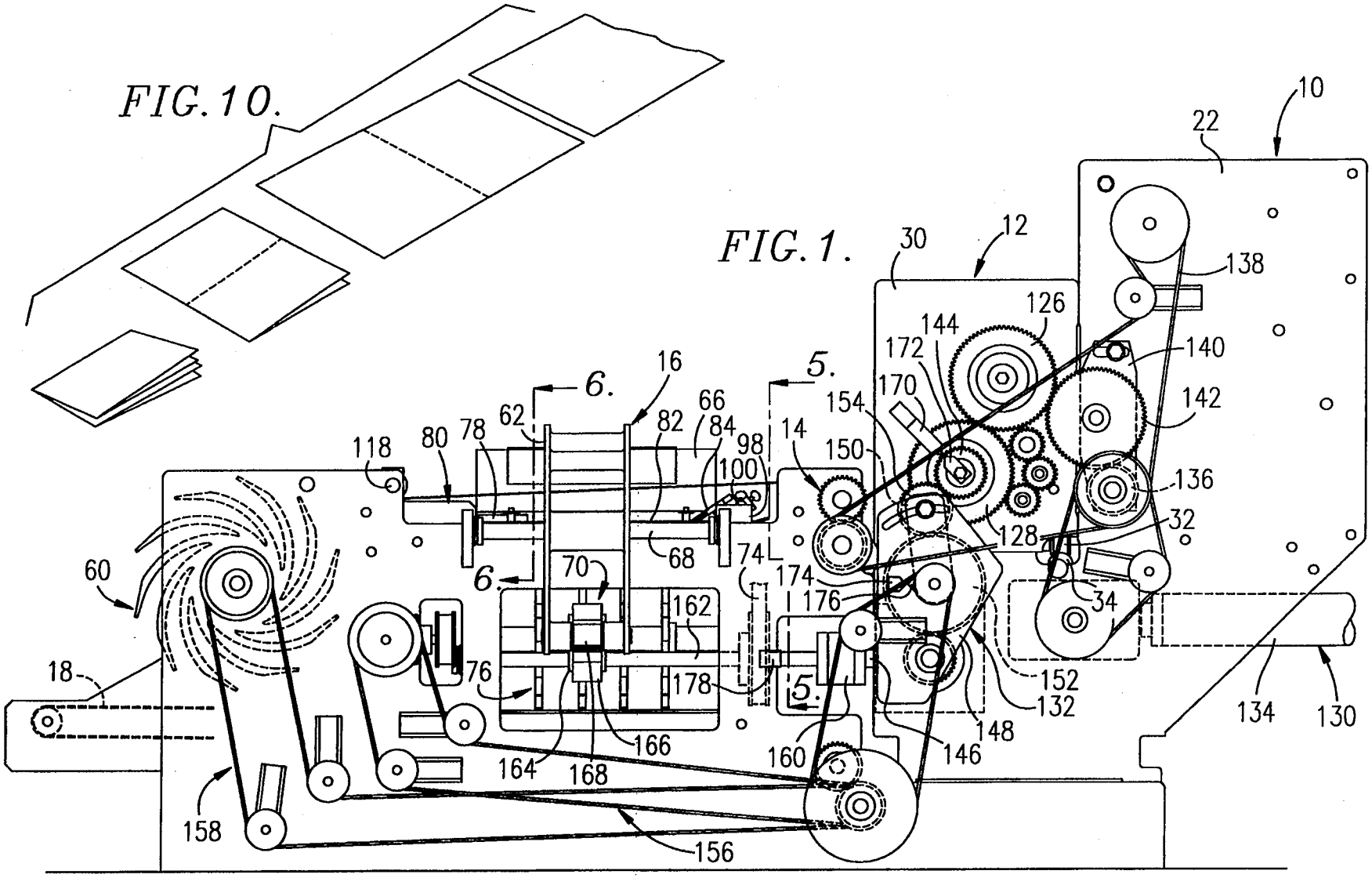
FIG. 1 is a side elevational view of a signature folder constructed in accordance with the preferred embodiment of the present invention.
FIG. 10 is a perspective view of a signature in the various stages of folding as carried out by the apparatus.

A preferred construction of a folder apparatus for use with a web-fed printing press is illustrated in FIG. 1, and broadly includes an upstanding frame 10 on which an upstream folding assembly 12, an intermediate conveyor assembly 14, a downstream folding assembly 16, and a delivery conveyor 18 are supported.

Figure 2:
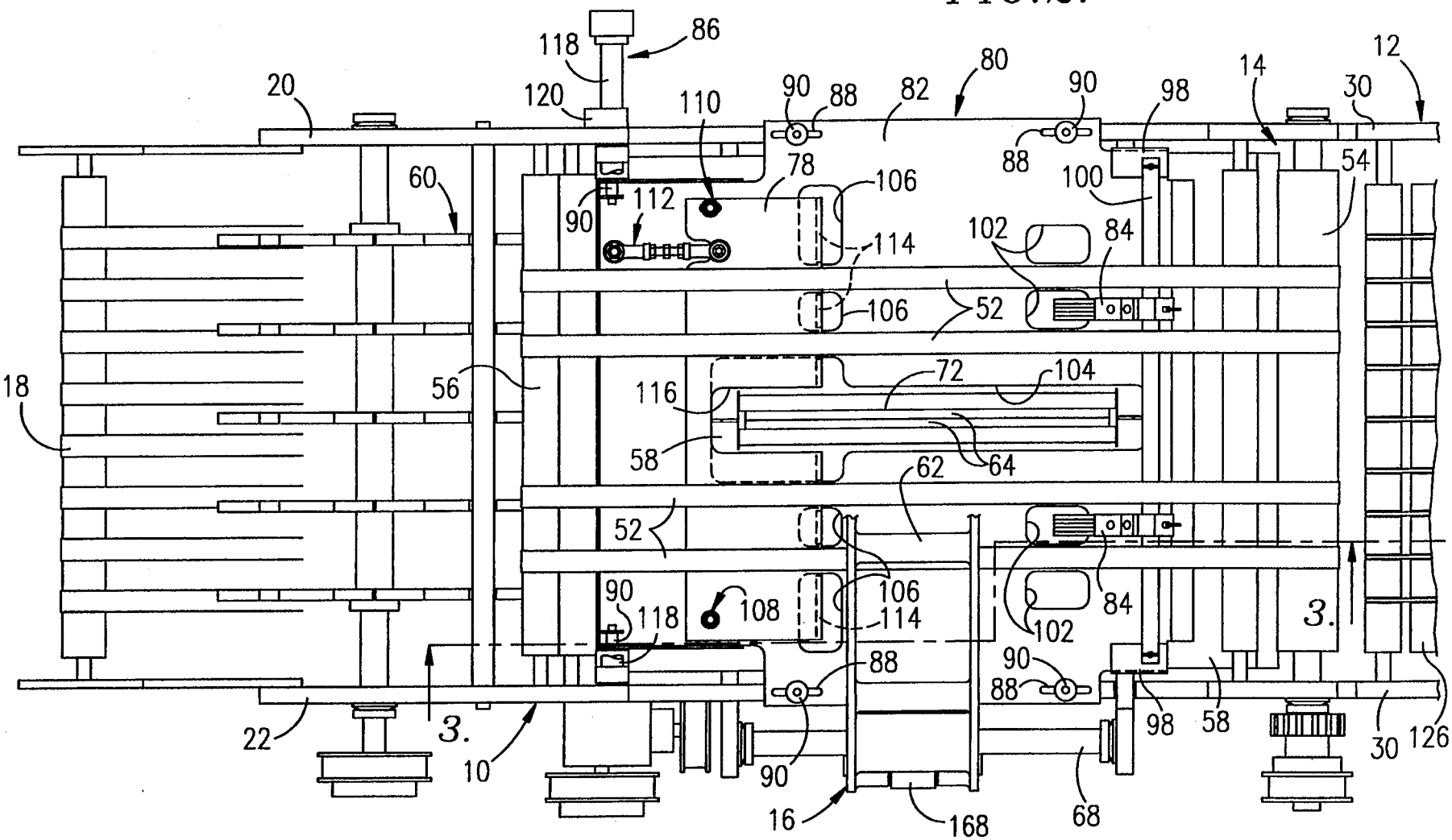
FIG. 2 is a fragmentary top plan view of the apparatus, illustrating a downstream folding assembly of the apparatus.
Figures 7, 8, 9:
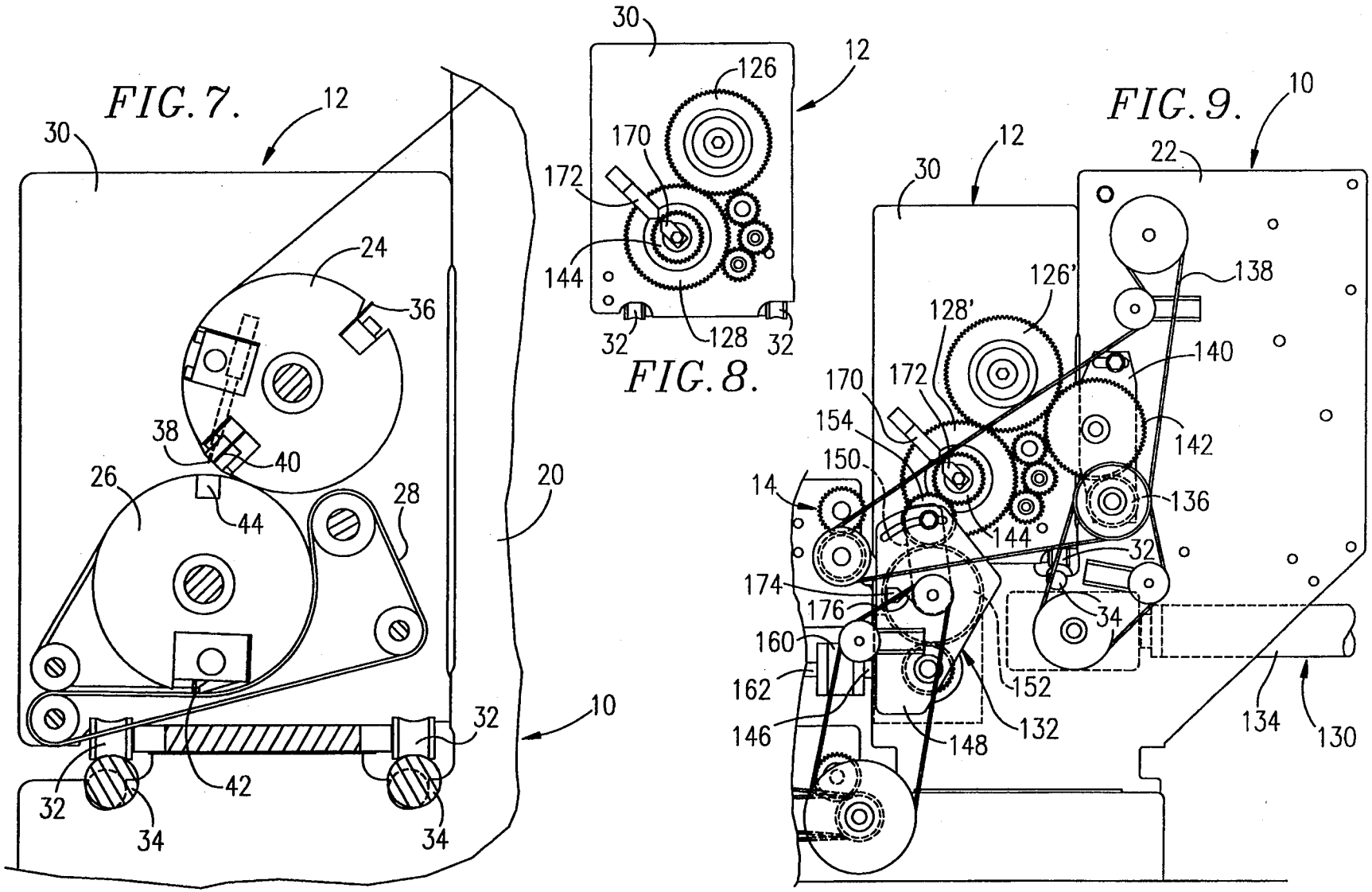
FIG. 7 is a fragmentary sectional view of an upstream folding assembly.
FIG. 8 is a side elevational view of a cassette on which the upstream folding assembly is supported.
FIG. 9 is a fragmentary side elevational view similar to FIG. 1, illustrating the use of a replacement cassette in the upstream folding assembly to vary the size of the signatures to be folded by the apparatus.

As illustrated in FIG. 2, the frame includes a pair of spaced side walls 20, 22 on which the assemblies 12, 14, 16 are mounted. Preferably, the frame is adapted to be arranged at the delivery end of a web-fed printing press so that the printed web delivered from the press is fed directly to the folder apparatus. As illustrated in FIG. 7, the web is then trained through the upstream folding assembly 12 where the web is cut into sheets, and cross folded along a fold line extending in a direction transverse to the length of the web.

Thereafter, the cross-folded sheet is conveyed to the downstream folding assembly 16 where it is folded along a fold line extending in a direction transverse to the cross fold line before being delivered from the apparatus. This progression from web to sheet and from sheet through multiple folding operations is illustrated in FIG. 10.

The upstream folding assembly is illustrated in FIG. 7, and includes a tucker cylinder 24, a gripper cylinder 26, and a conveyor 28, all of which are supported between the two side walls 30 of a cassette which is removable from the frame so as to enable replacement of the assembly° Although only a single folding station is illustrated in the upstream folding assembly, it is noted that multiple folding operations can be carrier out by adding additional stations or cylinders.

The cassette is adapted to fit within and engage the frame of the apparatus, and is equipped with a plurality of concave wheels 32 which extend slightly below the side walls 30 so that the cassette can be moved along complementary rails 34 extending between and secured to the walls of the frame 10. U.S. Pat. No. 5,060,569, issued 29 Oct. 1991, relates to an apparatus for changeover of cylinders in a web-fed printing press, and discloses the use of a cassette structure of the type preferably employed in the present folder apparatus. This patent disclosure is incorporated herein.

The tucker cylinder 24 includes a tucker 36, which is a thin piece of spring steel extending the length of the cylinder and protruding slightly from the surface of the cylinder. Opposing the tucker on the tucker cylinder is a row of pins 38 and a cutting edge 40, both of which extend longitudinally of the cylinder and protrude slightly from the cylinder surface. The gripper cylinder 26 includes a row of jaws 42 and a conventional mechanism for opening the jaws as they come into registration with the tucker 36 so that a signature supported on the tucker cylinder is pressed into the jaws by the tucker and carried with the gripper cylinder 26.

Opposing the jaws on the gripper cylinder 26 is a backup member 44 which registers with the row of pins 38 and cutting edge 40 of the tucker cylinder, enabling the signature carried on the tucker cylinder to be cut so that it may be carried on the gripper cylinder from the assembly. At the same time, the row of pins 38 engage the free end of the web, holding the next signature against the tucker cylinder until the signature is gripped, cut and pulled from the tucker cylinder by the gripper cylinder.

The conveyor 28 defines a nip with the gripper cylinder 26 and presses the signature against the gripper cylinder so that the signature is compressed along the fold line to complete the cross folding operation on the sheet. In addition, the conveyor delivers each cross-folded signature to the intermediate conveyor assembly, as shown in FIG. 3 so that the signature may be transported to the downstream folding assembly 16.

Figure 3:
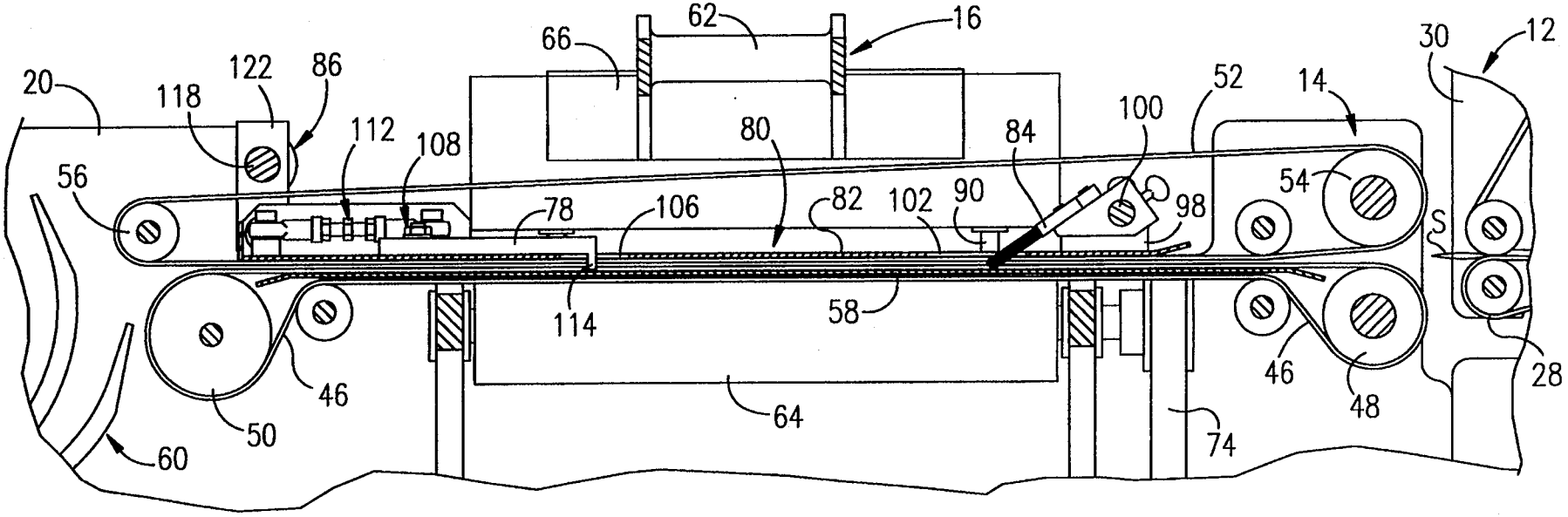
FIG. 3 is a fragmentary sectional view taken along line 3-3 of FIG. 2.

Turning to FIG. 3, the intermediate conveyor assembly 14 includes a lower conveyor 46 including a plurality of conveyor belts trained about two spaced rollers 48, 50. The assembly 14 also includes an upper conveyor 52 formed by a plurality of conveyor belts trained about two spaced rollers 54, 56. The upper conveyor is positioned immediately over the lower conveyor so that as signatures are fed to the intermediate conveyor assembly from the upstream folding assembly 12, they are held between and transported by the conveyors 46, 52.

Additional support is provided to the lower conveyor 46 by a support plate 58 which is connected to the frame and extends between the rollers across the width of the apparatus. This plate allows the upper conveyor 52 to apply pressure to the signatures being conveyed so that the signatures are positively transported along the assembly 14.

It is possible to employ the apparatus in a first mode, wherein once each signature has been folded within the upstream folding assembly 12, it by-passes the downstream folding assembly 16 and is delivered from the apparatus. In order to enable this mode of operation, the apparatus includes a creel 60 positioned at the downstream end of the intermediate conveyor assembly 14 for receiving signatures from the conveyor assembly and depositing them on the delivery conveyor 18. The creel includes a plurality of protruding, curved fingers within which the signatures are received as the signatures exit the conveyor assembly, and is rotated in a clockwise direction, as shown in FIG. 1, so that the signatures are deposited on the delivery conveyor.

Figure 5:
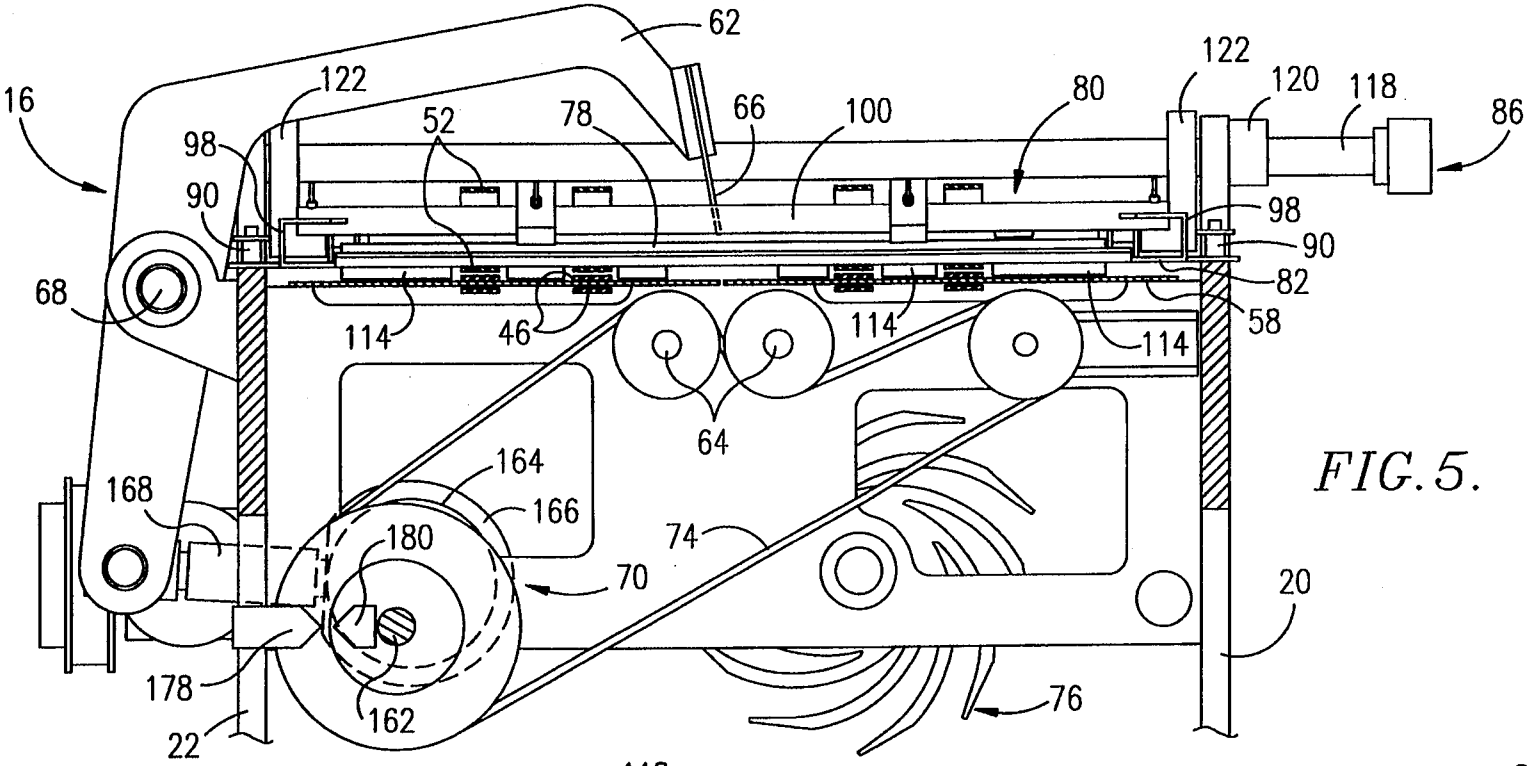
FIG. 5 is a fragmentary sectional view taken along line 5-5 of FIG. 1.

The downstream folding assembly 16 is shown in FIG. 5, and includes a chopper 62 and a pair of rollers 64. The chopper includes an elongated, angled body formed by a pair of spaced side walls which are secured together by a number of cross pieces. A chopper blade 66 formed of a rectangular flat piece of spring steel or the like is supported at one end of the chopper 62 and presents an edge extending in a direction parallel to the direction of travel of the web through the apparatus.

The chopper is supported on a shaft 68 extending along the side wall 22 of the frame 10 in a direction parallel to the direction of travel of the web. The chopper may be pivoted about this shaft 68 between a raised position in which the blade 66 is disposed above the delivery path defined between the upper and lower conveyors 52, 46 of the intermediate conveyor assembly 14, and a lowered position in which the chopper blade passes through the delivery path into the nip defined by the rollers 64.

A drive assembly 70 is connected to the chopper 62 opposite the shaft 68 from the chopper blade 66, and drives the chopper between these positions during operation of the assembly. As described below, a drive control means is associated with the drive assembly 70 for enabling and disabling the downstream folding assembly independent of operation of the upstream folding assembly. Thus, it is possible to disable the drive to the chopper in order to allow the production of cross-folded sheets, or to enable the chopper when chop folding is also desired.

The rollers 64 are supported on the frame beneath the intermediate conveyor assembly 14, and extend in a direction parallel to the direction of travel of the web. The support plate 58 supporting the upper run of the lower conveyor 46 includes a horizontal opening 72, shown in FIG. 2, aligned with the nip defined by the rollers 64. Returning to FIG. 5, the drive assembly 70 also drives the rollers 64 via a belt 74 so that the rollers rotate inward toward one another.

Thus, during a folding operation within the downstream folding assembly 16, a cross-folded signature positioned beneath the chopper 62 is forced downward past the lower conveyor 46 by the chopper as the chopper moves to the lowermost position. The blade 66 forms the fold line in the signature and pushes the signature into the nip between the rollers 64 so that the signature is pulled from the conveyor as a fold is formed along the fold line by the pressure between the two rollers. A creel 76 similar to the creel 60 is supported on the apparatus beneath the rollers 64, and includes a plurality of protruding fingers which receive chop-folded signatures from the rollers 64 and deposits the signatures on the delivery conveyor 18.

As illustrated in FIG. 3, a head stop 78 is positioned within the delivery path for limiting the movement of each signature along the path and for positioning the signatures relative to the downstream folding assembly. In addition, the apparatus includes an adjustment means for adjusting the position of the head stop along the delivery path during operation of the downstream folding assembly so that the position of the head stop may be adjusted without shutting off the apparatus.

The head stop and adjustment means preferably take the form of a slide plate assembly 80 which includes a generally rectangular slide plate 82 on which the head stop 78 and a pair of tail brushes 84 are supported, and an adjustment mechanism 86 for supporting the plate on the apparatus.

As shown in FIG. 2, the slide plate 82 is substantially flat, having a pair of lateral extensions which rest on the side walls 20, 22 of the frame when the side plate assembly is positioned on the apparatus° A pair of axially aligned slots 88 are formed in the slide plate 82 within each of these extensions, and removable fasteners 90 are provided which retain the plate on the side walls of the frame.

Figure 6:
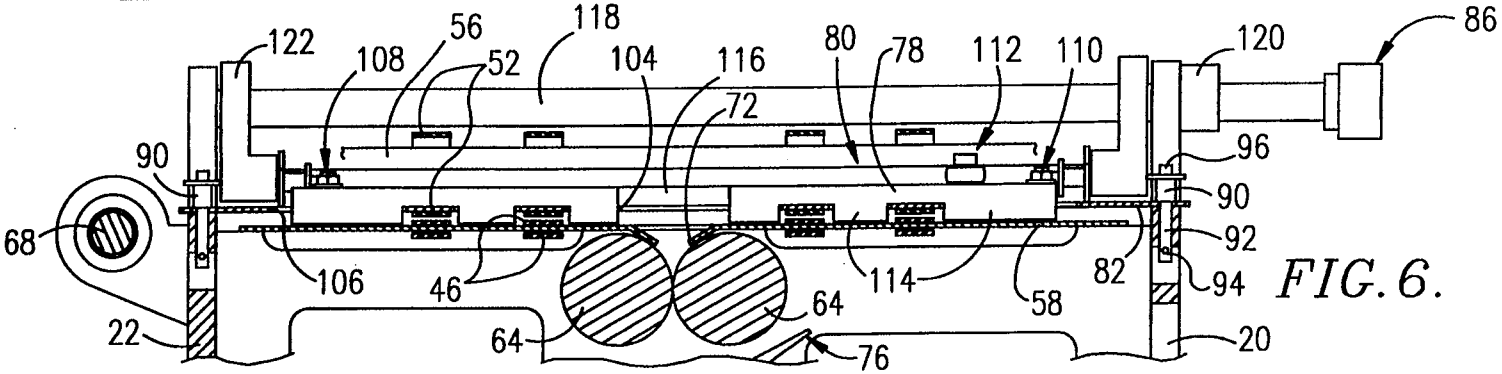
FIG. 6 is a fragmentary sectional view taken along line 6-6 of FIG. 1.

The fasteners are illustrated in FIG. 6, and are of conventional construction, each including an elongated, hollow pin 92 provided with a transverse hole adjacent the bottom end through which a ball 94 protrudes to retain the pin on the frame. A release button 96 is provided on each fastener for releasing the ball into the pin so that the pin may be pulled from the frame to permit the plate to be lifted or removed from the apparatus.

Turning to FIG. 5, the slide plate 82 includes a pair of upstanding L-shaped lugs 98 to which a transverse bar 100 is connected. As illustrated in FIG. 2, a plurality of holes 102 are formed in the plate downstream of these lugs 98, and the tail brushes 84 are supported on the transverse bar and protrude through the holes into the delivery path. The brushes are adapted to engage each signature as it travels toward the head stop 78 to prevent the signatures from bouncing from the head stop out of alignment with the chopper 62.

An elongated, generally rectangular slot 104 is also formed in the plate, and extends in a direction parallel to the direction of travel of the web. This slot 104 is adapted to be aligned with the nip rollers 64 so that during a folding operation by the downstream folding assembly 16, the chopper is able to pass through the slot. Additional holes 106 are formed in the slide plate to either side of the elongated slot 104 downstream of the tail brushes. These holes 106 are spaced from one another by a distance corresponding to the spacing between belts of the upper and lower conveyors 46, 52 so that the holes extend through the plate within an area aligned with the gaps between the belts.

The head stop is also illustrated in FIG. 2, and is formed of a rectangular piece of steel that is secured to the slide plate 82 by bolt and nut assemblies 108, 110 positioned at each end of the head stop. A hole is provided in the head stop through which the assembly 108 is received, and defines an axis about which the head stop may be pivoted relative to the plate. The other bolt and nut assembly 110 is received within a slot formed in the head stop so that, when the nuts of the assemblies 108, 110 are loosened, the head stop may be pivoted relative to the plate. A threaded adjustment member 112 is supported between the head stop and slide plate at a position opposite the pivot axis, and is operable to carry out the pivoting movement of the head stop to adjust the angular position of the stop relative to the chopper once the slide plate assembly is in position on the apparatus.

The head stop 78 includes a number of depending legs 114, as shown in FIG. 6, aligned with and extending through the holes 106 in the plate 82. In addition, the head stop includes a central cut-away region 116 aligned with the elongated slot 104 in the plate and with the underlying nip rollers 64. The depending legs 114 on the head stop are sized to extend beneath the plate 82 into the delivery path defined within the conveyor assembly to present a head wall against which each signature is forced as the signature is conveyed through the apparatus. The function of the head stop is to position each signature beneath the chopper prior to the second folding operation and to square the signature with the chopper so that the fold is accurately made.

As shown in FIG. 3, the downstream end of the slide plate 82 is formed with upstanding side and end walls by which the plate is connected to the adjustment mechanism 86. Turning to FIG. 6, the adjustment mechanism includes an elongated shaft 118 attached to the side walls 20, 22 of the frame, and one end of the shaft protrudes through the side wall 20 to support a handle by which the shaft may be rotated relative to the frame.

A block 120 of relatively resilient material such as nylon or the like is mounted on the side wall 20 and includes an opening through which the shaft extends, the opening being of an adjustable size so that it is possible to adjust the frictional pressure exerted on the shaft by the block. The shaft 118 may be rotated by overcoming the frictional force exerted by the block 120, but the shaft is normally retained in place by the block so that normal vibration of the apparatus does not upset the position of the shaft.

Figure 4:
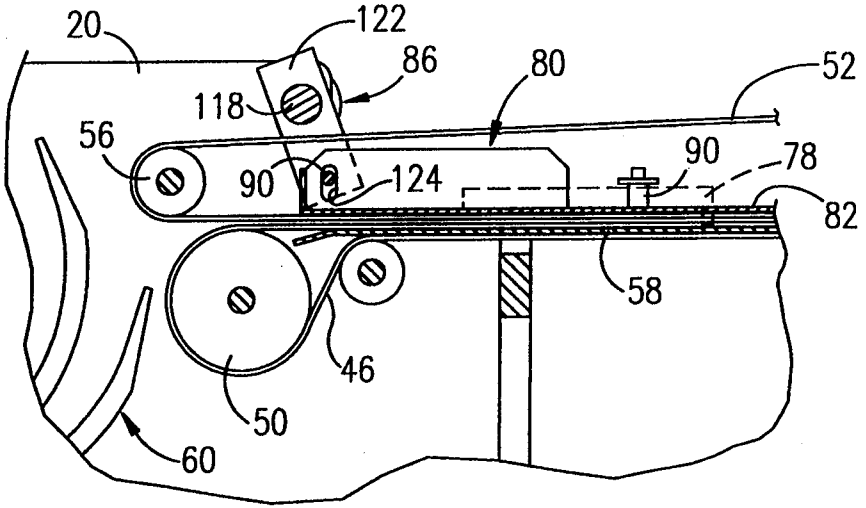
FIG. 4 is a fragmentary side sectional view similar to FIG. 3, illustrating an adjusted position of a slide plate assembly associated with the downstream folding assembly.

An L-shaped lug 122 is secured to the shaft 118 adjacent the inside of each side wall 20, 22, the lugs depending from the shaft and including a lower flange to which the slide plate 82 is secured. Preferably, additional fasteners 90 are employed to retain the plate on the frame. The fasteners extend into the lugs 122 through vertical slots 124 formed in the side walls of the plate, as shown in FIG. 4, so that when the shaft is rotated, the lugs force the plate to slide relative to the frame in a direction parallel to the direction of web travel.

When the apparatus is to be used in a chop-fold mode, the slide plate assembly 80 is positioned in the apparatus over the lower run of the upper conveyor 52 of the intermediate conveyor assembly 14, as shown in FIG. 3, and the plate 82 is supported on the side walls 20, 22 by the removable fasteners 90. In addition, the plate is connected to the lugs 122 of the adjustment mechanism 86 by the additional fasteners 90.

If it is necessary to adjust the angle of the head stop 78 in order to square the stop relative to the nip defined by the rollers 64, the bolt and nut assemblies 108, 110 are loosened and the threaded adjustment member 112 is operated to adjust the angular position of the stop. Once properly adjusted, the head stop is again secured to the plate by tightening the nut and bolt assemblies.

Once the slide plate assembly 80 is in position and the downstream folding assembly has been enabled, as described below, the apparatus is setup for chop-fold operation. Upon start-up, each cross-folded signature delivered from the upstream folding assembly is conveyed along the delivery path until it abuts the head stop 78, which positions the signature relative to the chopper blade 66 and squares the signature so that it is folded along the desired fold line.

Thereafter, the chopper 62 is moved into engagement with the signature and forces it between the rollers 64 so that the rollers may fold the signature and pull it from the intermediate conveyor assembly 14. The chop-folded signature is then delivered from the rollers to the creel 76 which deposits the signature on the delivery conveyor 18.

One advantage achieved through the use of the preferred construction of the present invention is that in addition to supporting the head stop 78 for adjustment relative to the folding assembly 16, the slide plate also substantially covers the signatures as they are engaged by the rollers 64 and pulled from the conveyor assembly 14. Normally the signatures would be free to whip up between the belts of the conveyor assembly 14 as they are folded. However, the plate prevents such whipping action, preventing the signatures from being improperly folded across a corner and ensuring that a high-quality product results.

If, during operation of the apparatus, the signature is engaged by the chopper before reaching the head stop 78, or if the signature hits the stop with so much momentum as to possibly damage the signature, the position of the head stop may be adjusted. The desired position for the head stop is one in which each signature contacts the head stop with enough force to square the signature to the chopper but without sufficient force to damage the signature.

In order to carry out adjustment of the head stop, the operator rotates the shaft 118 of the adjustment mechanism 86, overcoming the friction force exerted by the block 120 and pushing or pulling the slide plate 82 and head stop in either the upstream or downstream direction. For example, if the signatures are not reaching the head stop before the chop-folding operation, the shaft 118 is rotated in the counterclockwise direction, as shown in FIG. 4, so that the lugs push the plate in the upstream direction. This sliding movement of the plate is allowed and guided by the removable fasteners 90 extending into the side walls of the frame. Thus, adjustment of the head stop may be made "on the fly" without shutting the apparatus down, and further adjustments may be made, if necessary to obtain the proper alignment of the head stop for various signature sizes, press speeds and folding configurations.

As mentioned, the upstream folding assembly 12 is provided on a cassette which is removable from the apparatus to enable replacement of the cassette and of the assembly. Thus, if the folder apparatus is to be used with a convertible web-fed press, such as the press marketed by Didde Web Press Corporation under the name Didde VIP Web Offset Variable Insert Press, the folder apparatus may also be converted to fold such variable sized signatures simply by replacing the cassette which supports the upstream folding assembly.

The cassette is shown removed from the apparatus in FIG. 8, and includes a gear train supported outside one of the side walls 30 for driving the tucker and gripper cylinders 24, 26, as well as the conveyor 28. The gears 126, 128 associated with the tucker and gripper cylinders are sized proportionally to the size of the cylinders so that operation of the upstream folding assembly may be coordinated with operation of the downstream folding assembly regardless of the size of the cylinders 24, 26. For example, a cassette supporting a folding assembly for use with relatively large signatures is shown in FIG. 9, and includes gears 126', 128' which are oversized relative to the gears 126, 128 of the cassette shown in FIGS. 1 and 8.

In order to permit the upstream folding assembly to be replaced with variable sized cylinders, and to allow the downstream folding assembly to be enabled and disabled when desired, the apparatus is provided with a unique drive system including a registration means for registering the two folding assemblies 12, 16 with each other so that after the cassette is replaced or the downstream folding assembly is enabled, the two assemblies may be registered with one another.

This drive system is shown in FIG. 1, and broadly includes an input drive assembly 130, the gears 126, 128 forming the train for the upstream folding assembly 12, a transmission assembly 132, and the drive assembly 70 for the downstream folding assembly 16.

The input drive assembly 130 includes a rotating shaft 134 which transmits drive to the apparatus from the upstream printing press. This drive is transmitted through a gear box and a belt-and-pulley arrangement to a drive gear 136. The belt-and-pulley arrangement also provides drive through a belt 138 to the upper and lower conveyors 46, 52 of the intermediate conveyor assembly so that the conveyors operate whenever the upstream folding assembly is operated.

A swing arm 140 is supported on the axis of the drive gear 136 for pivotal movement about the axis, and a swing gear 142 is mounted for rotation on the swing arm and engages the drive gear. When the swing arm is pivoted in the counterclockwise direction, as shown in FIG. 1, the swing gear 142 is moved into engagement with the tucker gear 126 and drives the upstream folding assembly. However, the swing gear may be disengaged from the tucker gear by pivoting the swing arm in the opposite direction.

A small gear 144 is attached to the gripper gear for rotation with the gripper gear, and engages the transmission assembly for transmitting drive to the downstream folding assembly. The transmission assembly 132 includes a gear train connected between the gear train of the upstream folding assembly 12 and an output shaft 146 which defines a power take-off. The transmission gear train is supported on a plate 148 that is secured to the side wall 22 for pivotal movement between the position shown in FIG. 1, and a pivoted position in which the plate is removed from the space within which the cassette is received. In this manner, the plate 148 may be pivoted to allow replacement of the cassette.

A swing arm 150 is supported on the plate 148 for pivoting movement about an axis on which a gear 152 of the train rotates, and a swing gear 154 is supported on the swing arm and engages the gear 152. The swing arm 150 is movable to bring the swing gear 154 into engagement with the small gear 144 of the folding assembly 12 so that the transmission receives drive from the folding assembly. This drive is transmitted through the transmission gear train to a gear box within which it is converted into rotational movement of the output shaft 146. A pair of belt-and-pulley assemblies 156, 158 are also provided which receive drive from the transmission gear train and transmit this drive downstream to the two creels 60, 76 and the delivery conveyor 18.

The drive control means of the downstream folding assembly includes a coupler 160 provided on the output shaft 146 for coupling the shaft to a drive shaft 162 of the drive assembly 70, and this coupler may be engaged or disengaged in order to selectively transmit driving force to the folding assembly 16. The coupler may be an electrically actuated clutch, or can include a manually operated clutch or coupler that slides axially on the shafts between the engaged and disengaged positions.

As shown in FIG. 5, the drive assembly 70 includes the drive shaft 162, on which an eccentric cam 164 is secured, and a yoke 166 which rides on the outside diameter of the cam. The yoke 166 is connected to the chopper by a rock shaft 168 which transmits the eccentric movement of the cam to the body to move the chopper through repeated cycles of pivoting motion about the shaft 68.

As illustrated in FIG. 1, the registration means associated with the drive system includes a first indicium 170 provided on the side wall 30 of the cassette and a first pointer 172 provided on the gear 144 so that the first pointer may be aligned with the first indicium to properly register the tucker and gripper cylinders 24, 26 relative to the transmission assembly 132 and the downstream folding assembly 16 when the cassette is first positioned on the apparatus.

A second indicium 174 is provided on the side wall 22 adjacent the transmission assembly, and a second pointer 176 is attached to the gear so that the second pointer may be aligned with the second indicium before the transmission means is connected to either of the upstream or downstream folding assemblies 12, 16. Thus, regardless of which of the folding assemblies is being connected to the drive system, it will be properly registered with the other assembly by first positioning the transmission assembly in the reference position.

The registration means also includes a third indicium 178 (see FIG. 5) provided on the side wall 22 adjacent the drive shaft 162 of the drive assembly 70, and a third pointer 180 provided on the drive shaft 162 in a position adapted to be aligned with the third indicium to properly register the downstream folding assembly with the upstream folding assembly 12 before enabling the downstream assembly. The printing press drive system also is provided with an identical arrangement, wherein a pointer is attached to the drive shaft 134, and an indicium is placed on the printer frame at a position relative to the shaft which, when aligned with the pointer, indicates registration of the press with the folder apparatus. Such an arrangement is conventional, and is included on the particular Didde press described above.

By providing the indicia 170, 174, 178 and pointers 172, 176, 180 within the drive system of the folder apparatus, it does not matter which of the assemblies is removed from service, and either assembly may be brought back into service in registration with the other simply by aligning the pointer 176 with indicium 174 of the transmission assembly, and the pointer 172 or 180 with the indicium 170 or 178, before engaging the transmission assembly with the folding assembly.

Although the invention has been described with reference to the preferred embodiment illustrated in the attached drawing figures, it is noted that equivalents may be employed and substitutions made herein without departing from the scope of the invention as recited in the claims. For example, although the preferred embodiment illustrates an inexpensive, manually controlled slide plate assembly, it is possible to adjust the position of the head stop for any particular press speed by employing a speed follower circuit and a stepper motor for rotating the shaft 118 to position the head stop in response to the speed of the press.

Alternately, it is possible to place sensors on the head stop for sensing the force exerted by the signatures hitting the bar, wherein a control loop is connected with the sensors to change the position of the bar, if necessary to prevent the paper from striking the bar too hard.

It should be understood that many alternative operations occur on typical publication and newspaper folders which provide additional fold and finished product combinations. Any or all of these alternative operations could easily be added to the embodiment without effecting the scope of the invention.

The upstream folding assembly could contain one or more additional folding cylinders, providing the capability of folding more than one cross web fold. These optional folds could be located in any radial relationship with the original folds but are typically located to produce either one-third or one-fourth increment folds.

Prior to reaching the upstream folding assembly the web could be processed in one of the following manners. The web could be plow folded or former folded to produce folds in the direction of web travel. The web could be slit in the direction of travel and either separated or repositioned one ribbon on top of another. Multiple webs could be run through the folder. One or more webs could be stapled or glued together creating more completely finished products. Perforations could be created both cross web and in the direction of travel for aiding in the folding of products.

What is claimed is:

1. Apparatus for use with a web-fed printing press, the apparatus comprising:

an upstream folding means for cutting the web into sheets and cross folding each sheet along a first fold line extending in a direction transverse to the length of the web;

a conveyor means for delivering the cross-folded sheets from the upstream folding means along a delivery path;

a downstream folding means positioned along the delivery path for chop folding the cross-folded sheets along a second fold line extending in a direction transverse to the first fold line, and for delivering the chop-folded sheets from the apparatus, the downstream folding means including an elongated chopper positioned above the delivery path, and a pair of rollers below the delivery path presenting a nip aligned with the chopper, the chopper being movable into and out of the delivery path so that cross-folded sheets positioned at the downstream folding means are forced into the nip between the rollers-along the second fold line and are folded:

a head stop positioned within the delivery path for limiting the movement of the sheet along the path and for positioning the sheet relative to the downstream folding means;

a mounting means for mounting the head stop relative to the conveyor means and for allowing the head stop to be lifted from the delivery path; and an adjustment means for adjusting the position of the head stop along the delivery path during operation of the downstream folding means so that the position of the head stop may be adjusted without shutting off the apparatus, the mounting means including a slide plate positioned above the delivery path and including an opening through which the chopper passes during movement into and out of the delivery path; support means for supporting the head stop on the slide plate, and for allowing adjustment of the position of the head stop relative to the slide plate; and a plurality of removable fasteners for securing the slide plate to the apparatus so that the head stop may be lifted from the delivery path.

2. An apparatus as recited in claim 1, wherein the adjustment means includes a rotatable shaft extending across the width of the delivery path, and a pair of depending lugs, the slide plate being connected to the lugs by the removable fasteners so that when the shaft is rotated, the position of the head stop along the delivery path is adjusted.

3. An apparatus as recited in claim 1, wherein the slide plate includes a plurality of spaced holes, and the head stop includes a plurality of depending legs extending through the holes in the slide plate into the delivery path, the head stop being supported on the slide plate by a pin about which the head stop may be pivoted to adjust the angle of the stop relative to the downstream folding means.

4. An apparatus as recited in claim 3, further comprising a means for pivoting the head stop about the pin to adjust the position of the head stop relative to the slide plate and for securing the head stop to the slide plate once the angular position of the head stop has been adjusted.

5. An apparatus as recited in claim 2, wherein the slide plate includes a plurality of slots through which some of the removable fasteners extend so as to guide movement of the slide plate relative to the second folding means during operation of the adjustment means.

6. A sheet folder apparatus for use with a web-fed printing press, the apparatus comprising:

an upstream folding means for cutting the web into sheets and cross folding each sheet along a first fold line extending in a direction transverse to the length of the web;

a conveyor means for delivering the cross-folded sheets from the upstream folding means along a delivery path;

a downstream folding means positioned along the delivery path for chop-folding the cross-folded sheets along a second fold line extending in a direction transverse to the first fold line, and for delivering the chop-folded sheets from the apparatus;

drive means for driving the upstream folding means;

transmission means for transmitting the drive of the upstream folding means to the downstream folding means;

a cassette on which the upstream folding means is supported, the cassette being removable from the apparatus to allow replacement of the cassette and of the upstream folding means; and registration means for registering the two folding means with the transmission means and with each other so that after the cassette is replaced or the downstream folding means is enabled, the two folding means may be registered with one another.

7. An apparatus as recited in claim 6, wherein the drive means includes an input drive assembly supported on the apparatus and a gear train supported on the cassette, the input drive assembly including a drive gear movable into and out of engagement with the gear train to allow replacement of the cassette.

8. An apparatus as recited in claim 6, wherein the drive means transmits the drive of the upstream folding means to the conveyor means.

9. An apparatus as recited in claim 6, wherein the downstream folding means includes an elongated chopper positioned above the delivery path, and a pair of rollers below the delivery path presenting a nip aligned with the chopper, the chopper being movable into and out of the delivery path so that cross-folded sheets positioned at the downstream folding means are forced into the nip between the rollers along the second fold line and are folded.

10. An apparatus as recited in claim 7, wherein the transmission means includes a transmission gear train supported on the apparatus and being movable into and out of engagement with the gear train of the upstream folding assembly to allow replacement of the cassette.

11. An apparatus as recited in claim 10, wherein the transmission means includes a power take-off from which the downstream folding means is driven, the apparatus further comprising a coupler that can be connected to and removed from the power take-off to enable and disable operation of the downstream folding means.

12. An apparatus as recited in claim 7, wherein the registration means includes a first indicium provided on the cassette and a first pointer provided on the gear train so that the first pointer may be aligned with the first indicium to properly position the upstream folding means relative to the transmission means and the downstream folding means upon replacement of the cassette.

13. An apparatus as recited in claim 12, wherein the registration means includes a second indicium provided on the apparatus and a second pointer provided on the transmission gear train so that the second pointer may be aligned with the second indicium before the transmission means is connected to the upstream and downstream folding means.

14. An apparatus as recited in claim 13, wherein the registration means includes a third indicium provided on the apparatus and a third pointer provided on the downstream folding means so that the third pointer may be aligned with the third indicium to properly position the downstream folding means relative to the transmission means and the upstream folding means before enabling the downstream folding means.

* * * * *